US010629402B2

(12) United States Patent
Huang et al.

(10) Patent No.: US 10,629,402 B2
(45) Date of Patent: Apr. 21, 2020

(54) CATHODE ASSEMBLY AND X-RAY SOURCE AND CT DEVICE HAVING THE CATHODE ASSEMBLY

(71) Applicants: TSINGHUA UNIVERSITY, Beijing (CN); Nuctech Company Limited, Beijing (CN)

(72) Inventors: Wenhui Huang, Beijing (CN); Dongsheng Zhang, Beijing (CN); Qingxiu Jin, Beijing (CN); Chengjun Tan, Beijing (CN); Donghai Liu, Beijing (CN); Qun Luo, Beijing (CN); Chuanxiang Tang, Beijing (CN)

(73) Assignees: TSINGHUA UNIVERSITY, Beijing (CN); NUCTECH COMPANY LIMITED, Beijing (CN)

( * ) Notice: Subject to any disclaimer, the term of this patent is extended or adjusted under 35 U.S.C. 154(b) by 176 days.

(21) Appl. No.: 15/856,521

(22) Filed: Dec. 28, 2017

(65) Prior Publication Data

US 2018/0190465 A1 Jul. 5, 2018

(30) Foreign Application Priority Data

Dec. 29, 2016 (CN) ..... 2016 1 1246012

(51) Int. Cl.
*H01J 35/06* (2006.01)
*H05G 1/02* (2006.01)
(Continued)

(52) U.S. Cl.
CPC ..... *H01J 35/06* (2013.01); *H01J 35/08* (2013.01); *H01J 35/16* (2013.01); *H05G 1/02* (2013.01);
(Continued)

(58) Field of Classification Search
CPC .. H01J 35/06; H01J 35/08; H01J 35/14; H01J 2235/068; H01J 2235/02; H01J 35/02; H05G 1/02
See application file for complete search history.

(56) References Cited

U.S. PATENT DOCUMENTS 2,400,751 A * 5/1946 Gage ..... H01J 5/50 363/114
2003/0095632 A1* 5/2003 Kautz ..... H01J 35/06 378/137

(Continued)

FOREIGN PATENT DOCUMENTS

CN 201392805 Y 1/2010
CN 203537653 U 4/2014

(Continued)

*Primary Examiner* — Christine S. Kim
(74) *Attorney, Agent, or Firm* — Scully, Scott, Murphy & Presser, P.C.

(57) ABSTRACT

A cathode assembly, an X-ray source and a CT device are provided. The cathode assembly includes a ceramic plug having a first and second end portions. Four wiring terminals and a protruding positioning part are provided on the first end portion. An internal cavity is formed in the ceramic plug, and a cathode is provided therein. The cathode has a filament with a positive and negative electrode leads. A grid is provided on the second end portion and has a grid voltage signal line. The cathode has a cathode surface lead. The positive electrode lead, the negative electrode lead, the grid voltage signal line and the cathode surface lead are electrically connected to one of the wiring terminals, respectively. The ceramic socket has four wiring tubes which may be electrically connected with the four wiring terminals.

20 Claims, 5 Drawing Sheets

(51) Int. Cl.
*H01J 35/08* (2006.01)
*H01J 35/14* (2006.01)
*H01J 35/16* (2006.01)

(52) U.S. Cl.
CPC ..... *H01J 35/14* (2013.01); *H01J 2235/02* (2013.01); *H01J 2235/068* (2013.01)

(56) References Cited

U.S. PATENT DOCUMENTS

| | | | | |
|---|---|---|---|---|
| 2007/0114432 | A1* | 5/2007 | Kristiansson ..... | A61L 2/087 250/397 |
| 2015/0078532 | A1* | 3/2015 | Tang ..... | H01J 35/14 378/134 |
| 2016/0217965 | A1* | 7/2016 | Canfield ..... | H01J 35/045 |
| 2018/0277331 | A1* | 9/2018 | Schultheis ..... | H01J 35/165 |

FOREIGN PATENT DOCUMENTS

| | | | |
|---|---|---|---|
| CN | 206340510 | U | 7/2017 |
| EP | 0 630 039 | A1 | 12/1994 |
| JP | 3813967 | B2 * | 8/2006 |

* cited by examiner

CATHODE ASSEMBLY AND X-RAY SOURCE AND CT DEVICE HAVING THE CATHODE ASSEMBLY

CROSS REFERENCE

This application is based upon and claims priority to Chinese Patent Application No. 201611246012.8, filed on Dec. 29, 2016, the entire contents thereof are incorporated herein by reference.

TECHNICAL FIELD

The present disclosure relates to a cathode assembly, an X-ray source and a CT device having the cathode assembly.

BACKGROUND

X-ray is widely used in the fields of industrial non-destructive test, safety inspection, medical diagnosis and treatment. In particular, X-ray radiographic imaging devices owing to the high penetration performance of X-rays play an important role in all aspects of people's daily life. These devices were presented as film-based planar fluoroscopic imaging devices previously. At present, these devices with advanced technology are regarded as stereoscopic imaging devices with digital, multi-view; and high-resolution, for example computed tomography (CT), which may acquire high-resolution 3D stereoscopic image or slicing image as an advanced high-end application.

In the existing CT device, the X-ray generating device moves on the slip ring. In order to improve inspecting speed, moving speed of the X-ray generating device is usually quite fast, and thereby decreases reliability and stability throughout the device. In addition, due to limitation of the moving speed, the inspecting speed of the CT is also limited, so that inspection efficiency is lower. Furthermore, the X-ray sources of such devices move on the slip ring to cause focus of the equivalent X-ray sources larger such that the imaged pictures have motion artifacts and poor in the imaged images, poor resolution, and there is a possibility of missing inspection for some smaller contrabands. Besides, such devices may only inspect stationary (or slow-moving) objects but almost cannot form a three-dimensional image for the moving object.

Hot cathodes serve as electronic emission units and are arranged in array. The voltage between the hot cathode grids is used to control emission of electrons so as to control each cathode to emit electrons in sequence and to bombard target points on the anodes in the corresponding sequence, to establish an arranged X-ray source. By using an electronic switch instead of mechanical rotation of a spiral CT, the X-ray source may be rapidly generated from many views to rapidly image in different angles. This method may greatly improve inspection efficiency and enhance sharpness of the images. And, this scheme structure is simple, the system is stable and the reliability is higher.

In order to improve imaging quality of arranged light sources, it is generally required that light sources from the arranged light source are determined in a range of several tens to hundreds (as required), which means that a large amount of cathodes are required. The current design scheme is provided such that the cathode, a beam control electrode (grid), a compensation focus electrode is integrated together, if one of the cathodes (or cathode assembly) malfunctions, detaching and replacing are very complicated. Thus, the current design scheme is very inconvenient in terms of maintenance and replacement of an equipment.

The contents as above disclosed in this background are only employed to enhance understanding the technical background of this disclosure, thereby the existing knowledge that are not well-known for those skilled in the art may be included in this disclosure.

SUMMARY

Additional aspects and advantages of this disclosure will be set forth in part in the description and will be obvious in part from the description, or may be learned by implementation of this disclosure.

According to one aspect of this disclosure, a cathode assembly includes a ceramic plug and a ceramic socket. The ceramic plug has a first end portion and a second end portion arranged opposite to each other, wherein four wiring terminals are provided on an outer end surface of the first end portion, and a protruding positioning part is provided on a periphery surface of the first end portion; an internal cavity is formed in the ceramic plug, the internal cavity has an opening positioned at the second end portion; a cathode is provided in the internal cavity; the cathode has a filament with an positive electrode lead and a negative electrode lead; a grid is provided on an end surface of the second end portion and has a grid voltage signal line, the cathode has a cathode surface lead and the positive electrode lead, the negative electrode lead, the grid voltage signal line and the cathode surface lead are electrically connected to one of the wiring terminals, respectively. The ceramic socket has four wiring tubes, wherein the ceramic socket may be in contact with the first end portion of the ceramic plug, and the four wiring tubes may be electrically connected with the four wiring terminals.

According to another aspect of this disclosure, an X-ray source includes a vacuum chamber, an anode target provided in the vacuum chamber, a mounting plate provided in the vacuum chamber and separately provided with the anode target, and a plurality of mounting holes are provided on the mounting plate, a focus electrode, provided between the anode target and the mounting plate, wherein a plurality of focus through holes through which the electrons pass and which are in coincidence with the mounting holes are provided on the focus electrode, a compensation electrode provided between the focus electrode and the mounting plate, wherein a plurality of compensation through holes through which the electrons pass are provided on the compensation electrode, and the compensation through hole is in coincidence with the focus through holes such that the electrons may pass through the compensation through hole and the focus through hole orderly; and a plurality of the cathode assemblies of present disclosure detachably connected to the mounting hole, wherein the positioning part of the ceramic plug of the cathode assembly is matched with the mounting hole to position the cathode assembly.

According to another aspect of this disclosure, a CT device includes the present X-ray source.

BRIEF DESCRIPTION OF THE DRAWINGS

The foregoing features, aspects and advantages of the present disclosure will become more apparent from the following detailed description of the present disclosure when taken in conjunction with the accompanying drawings.

Figure 1:
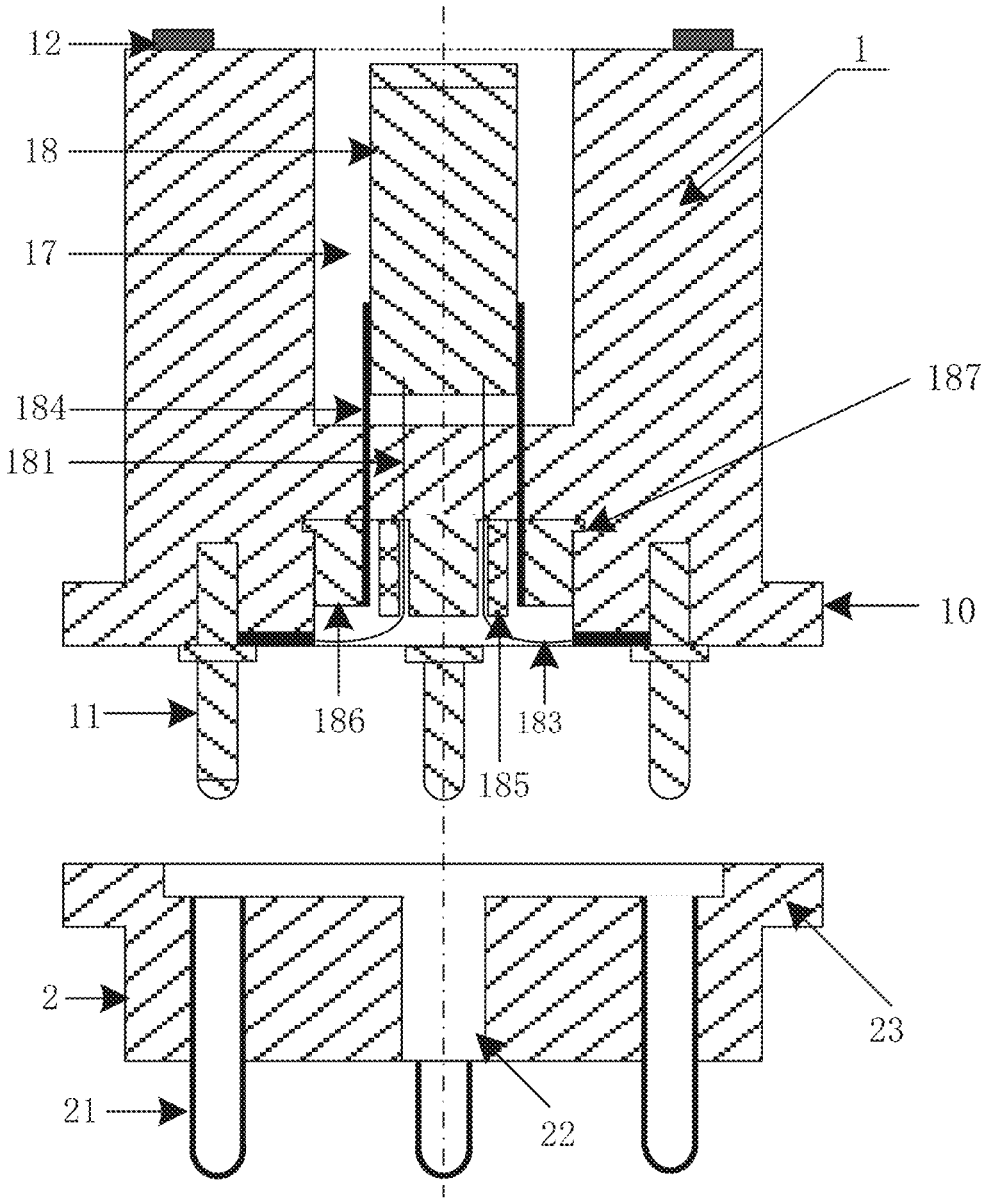
FIG. 1 is a schematic cross-sectional view of a cathode assembly according to an embodiment of the present disclosure.

In the drawings, 1. ceramic plug; 10. positioning part; 11. wiring terminal; 12. grid; 13. groove; 14. grid voltage signal line; 15. counter bore 17. internal cavity; 18. cathode; 181. filament; 182. positive electrode lead; 183. negative electrode lead; 184. support leg; 185. ceramic insulating ring; 186. metal fixing ring; 187. snapping part; 19. positioning hole; 2. ceramic socket; 21. wiring tube; 22. air hole; 23. annular flange; 3. vacuum chamber; 4. anode target; 5. mounting plate; 51. mounting hole; 6. focus electrode; 61. focus through hole; 7. compensation electrode; 71. compensation through-hole; 81. first cartridge; 82. second cartridge; 83. pressure plate; 84. fixing screw; 91. high-voltage connection device; 92. high-voltage connection device; 93. high-voltage power supply; 94. compensation focus power supply; 100. cathode assembly.

DETAILED DESCRIPTION

Exemplary embodiments will be completely described with reference to the drawings. This disclosure may, however, be embodied in many different forms and should not be construed as limited to the exemplary embodiments set forth herein. Rather, these exemplary embodiments are provided so that this disclosure is thorough and complete, and will fully convey the scope of this disclosure to those skilled in the art. The same reference hers will be used throughout the drawings to refer to the same or like parts, thereby the detailed description thereof will be omitted.

Figure 4:
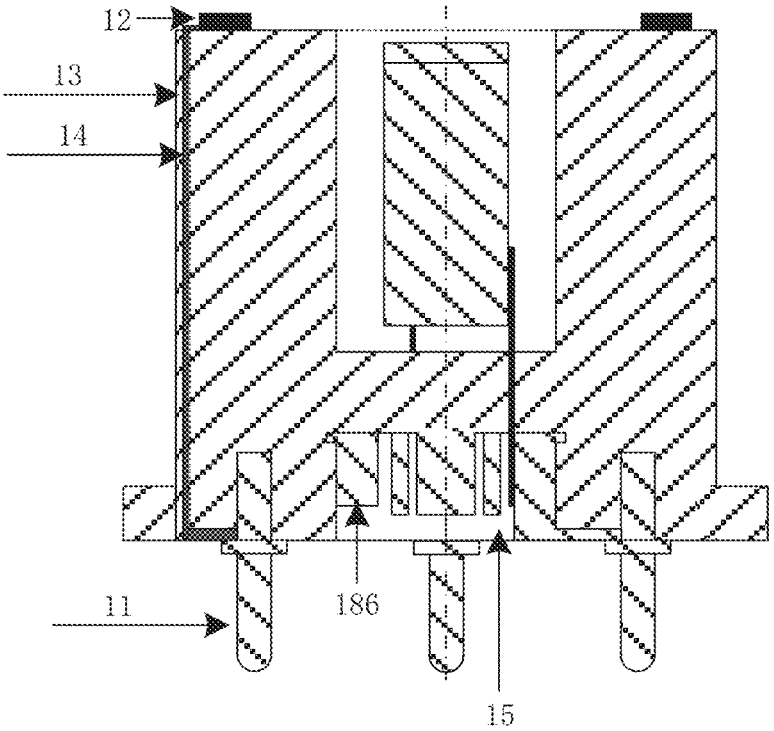
FIG. 4 is a schematic cross-sectional view of the ceramic plug cut from another viewing angle in FIG. 1.

Referring to to FIG. 4, an embodiment of the present disclosure discloses a cathode assembly 100 that is applied to an X-ray source and a CT device having such X-ray source. The cathode assembly 100 is a hot cathode that is able to emit electrons after being heated by electricity and generate X-ray by the electrons emitted thereby. The cathode assembly 100 of this embodiment includes a ceramic plug 1 and a ceramic socket 2. The ceramic plug 1 and the ceramic socket 2 are independent components separated from each other, but may be plugged together.

Figure 2:
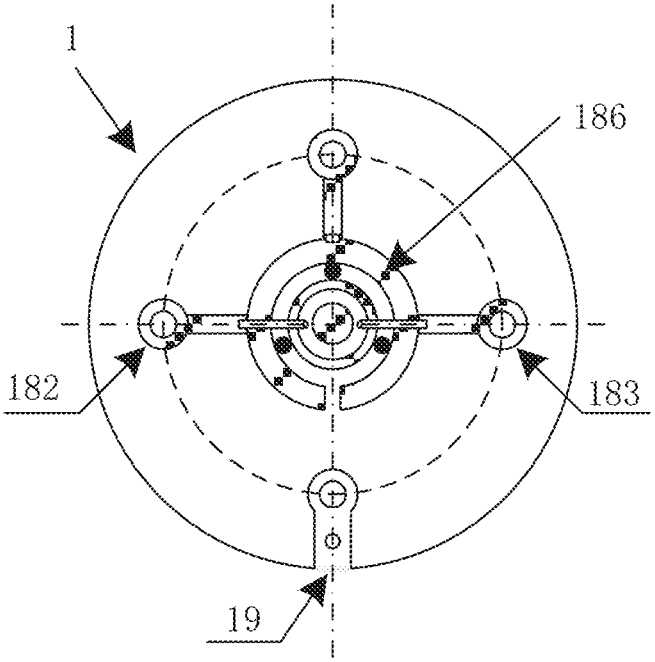
FIG. 2 is a back view of a ceramic plug in FIG. 1.
Figure 3:
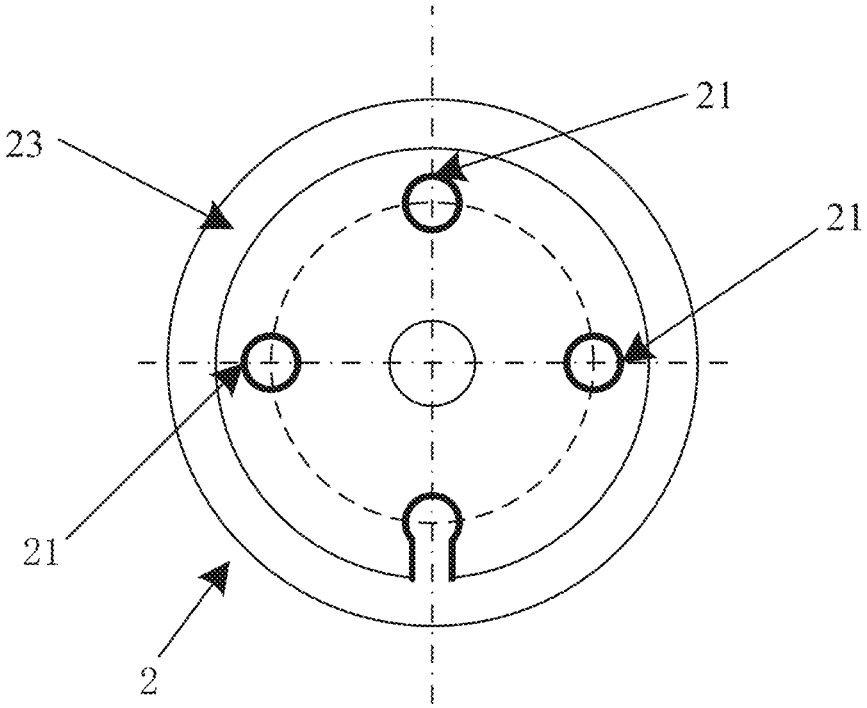
FIG. 3 is a back view of a ceramic socket in FIG. 1.

As shown in FIG. 1 to FIG. 3, in this embodiment, the ceramic plug 1 has a first end portion and a second end portion opposite to each other, and the first end portion and the second end portion are a tail portion and a head portion of the ceramic plug 1, respectively. Four wiring terminals 11 are provided on an outer end surface of the first end portion, and a protruding positioning part 10 are provided on a peripheral face of the first end portion. In this embodiment, the positioning parts 10 are annular steps but not limited thereto, for example, protruding and non-continuous protrusions. An internal cavity 17 is formed inside the ceramic plug 1. The internal cavity 17 has an opening at the second end portion and is provided with a cathode 18 therein. The cathode 18 has filament 181 for heating the cathode 18 and includes a positive electrode lead 182 and a negative electrode lead 183. The cathode 18 also has stationary support legs 184 for being soldered to the positioning part 186 to fix the cathode 18. The cathode support legs 184 are electrically connected to a cathode emitting face while leads of the cathode support legs 184 are led to form cathode surface leads. Grids 12 are provided on the end surface of the second end portion and have grid voltage signal lines 14. The positive electrode lead 182, the negative electrode lead 183, the grid voltage signal line 14 and the cathode surface lead are electrically connected to one of the wiring terminals 11, respectively.

The grid 12 is used to control whether the cathode 18 emits electrons. The cathode 18 is switched off and thereby does not emit the electrons when the grid 12 is under a negative bias voltage, and the cathode 18 may emit electrons when the grid 12 is under a positive bias voltage.

Furthermore, as shown in FIG. 2, the ceramic plug 1 has a cylindrical shape and is provided with a positioning hole 19 on the outer end surface of the first end portion. The four wiring terminals 11 and the positioning hole 19 are evenly around the axis of the ceramic plug 1. The positioning hole 19 may be used for positioning between the ceramic plug 1 and the ceramic socket 2.

As shown in FIG. 1 and FIG. 2, the ceramic socket 2 has four wiring tubes 21. The four wiring tubes 21 are positioned in correspondence to the four wiring terminals 11. The ceramic socket 2 may be brought into contact with the first end portion of the ceramic plug 1. The four wiring terminals 11 may be inserted into the wiring tubes 21 such that the cathode assembly starts to work after the wiring terminals 11 are electrically connected to the wiring tubes 21, and the wire connection bobbins 21 are connected to the exterior wires, when the ceramic socket 2 and the first end portion of the ceramic plug 1 are in contact with each other. The ceramic socket 2 may also be provided with the positioning hole having the same position with that on the ceramic plug 1, to avoid wrongly plugging. The ceramic plug 2 may also be provided with an air hole 22 that penetrates through the ceramic socket 2 and is perpendicular to the outer end surface of the first end portion. During air extraction, the air in the ceramic plug 1 may be drained out via the air hole 22 as soon as possible.

As shown in FIG. 4, a groove 13 for accommodating the grid voltage signal lines 14 may be opened on the outer surface of the ceramic plug 1. The groove 13 may be directly grinded on the ceramic plug 1. The groove 13 has a depth only required to accommodate the grid voltage signal lines 14. The grid voltage signal lines 14 are located in the groove 13 and thus may be isolated from the grid voltage signal lines 14, and meanwhile protect the grid voltage signal lines from being bumped.

As shown in FIG. 1 and FIG. 4, there is a counter bore 15 on the first end portion face of the ceramic plug 1. A metal fixing ring 186 is fixedly provided within the counter bore 15. The cathode 18 may have a plurality of support legs 184, which extend from the internal cavity 17 into the counter bore 15, and then being fixedly connected onto the metal fixing ring 186. The metal fixing ring 186 may be connected to any one of the wiring terminals 11. By adjusting length of support legs 184, the height of cathode 18 in the internal cavity 17 may be varied so as to adjust a distance between the cathode and the grid.

Further, in this embodiment, the metal fixing ring 186 is welded in the counter bore 15. During welding, the inner wall of the counter bore 15 is firstly metalized, and then the metal fixing ring 186 is welded to the counter bore 15. The metal fixing ring 186 of this embodiment may further be an elastic ring with an opening. A snapping part 187 bent outward is further disposed on the metal fixing ring 186, while an annular slot is disposed in the interior of the counter bore 15. The metal fixing ring 186, after being inserted into the counter bore 15, may be expanded under its own elastic force so that the snapping part 187 of the metal fixing ring engages with the annular slot, and then the welding of the metal fixing ring 186 may be completed, consequently the metal fixing ring is fixed more reliably. In this way, the metal fixing ring 186 will be remained in the counter bore 15 even if the welding portion of the metal fixing ring 186 loses effectiveness due to high temperature melting, to ensure system reliability.

Referring to FIG. 1, FIG. 2 and FIG. 4, a ceramic insulating ring 185 between the filament 181 and the support leg 184 may also be provided at the counter bore 15. The ceramic insulating ring 185 may separate the filament 181 from the support leg 184 in order to avoid short circuit therebetween. As a result, gap between the filament 181 and the support leg 184 may be reduced, such that the filament 181 is closer to the support leg 184, which is beneficial for reducing the size of the counter bore 15. When the support leg 184 passes through the ceramic insulating ring 185 to the counter bore 15, and then is welded to the fixing ring, because the support legs are small, the heat conduction rate is lower, the heat for transferring to the positioning part via the support legs when the cathode is switched on, and the temperature of the fixing support legs and the positioning part when the cathode is switched on is lower, so that reliability of the system will be improved greatly.

Figure 5:
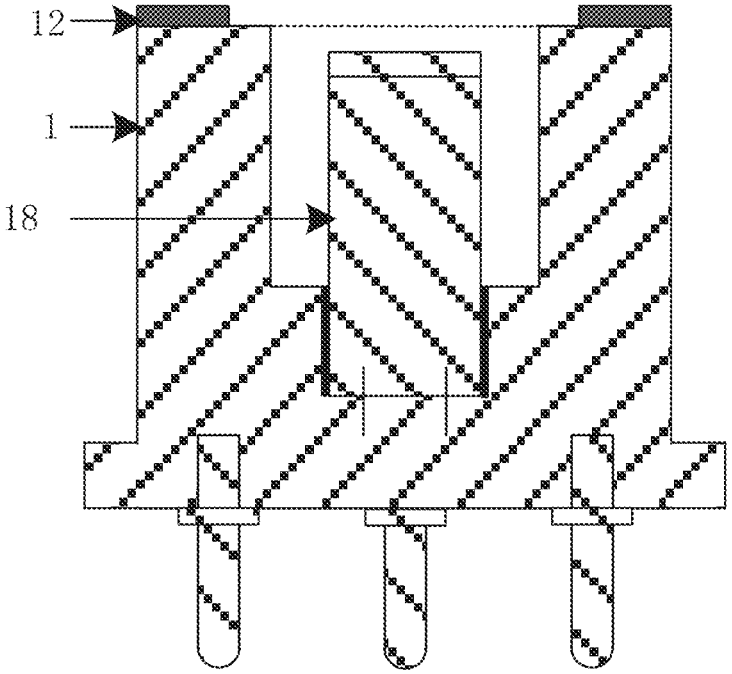
FIG. 5 is a structural diagram of the ceramic plug in the cathode assembly according to another embodiment of the present disclosure.

It should be understood by the person skilled in the art that the way by which the cathode 18 is connected to the ceramic plug 1 is not limited, and also may not have the support leg 184. FIG. 5 shows a cathode assembly according to another embodiment of this disclosure. In this embodiment, the cathode 18 is directly welded into the cavity 17.

The cathode assembly 100 of this disclosure has a simple and compact structure, if maintenance and replacement are required, it is more convenient to only disassemble the cathode assembly but without disassembling the compensation electrode and the focus electrode of the X-ray source. Significantly, the cost for maintenance and replacement may be reduced, convenience for the maintenance is improved, and the service life of the device may be prolonged.

Figure 6:
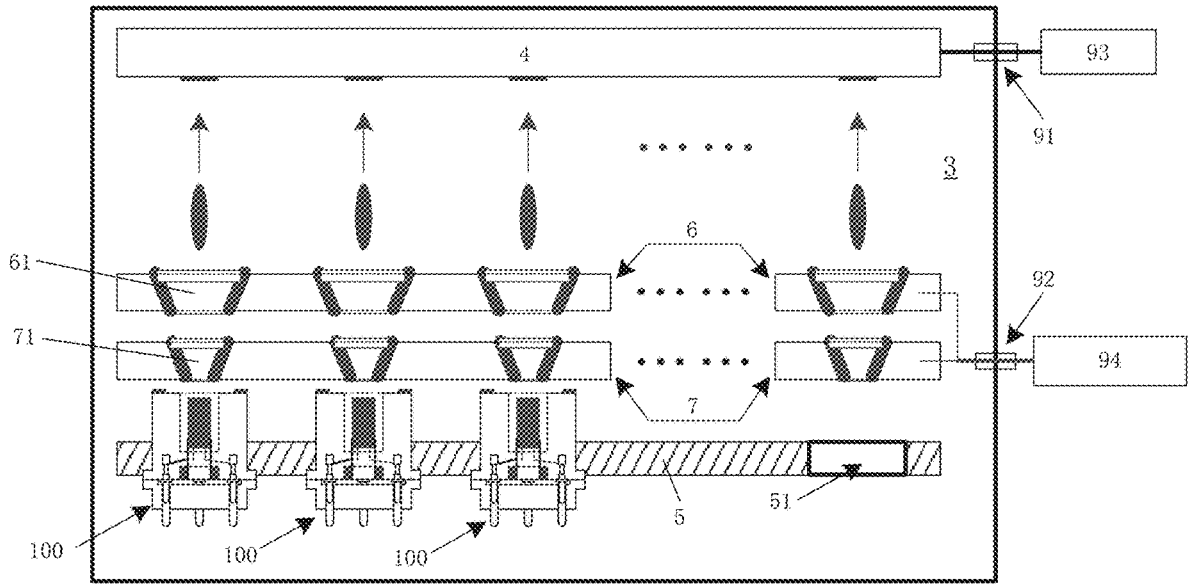
FIG. 6 is a structural diagram of an X-ray source according to an embodiment of the present disclosure.
Figure 7:
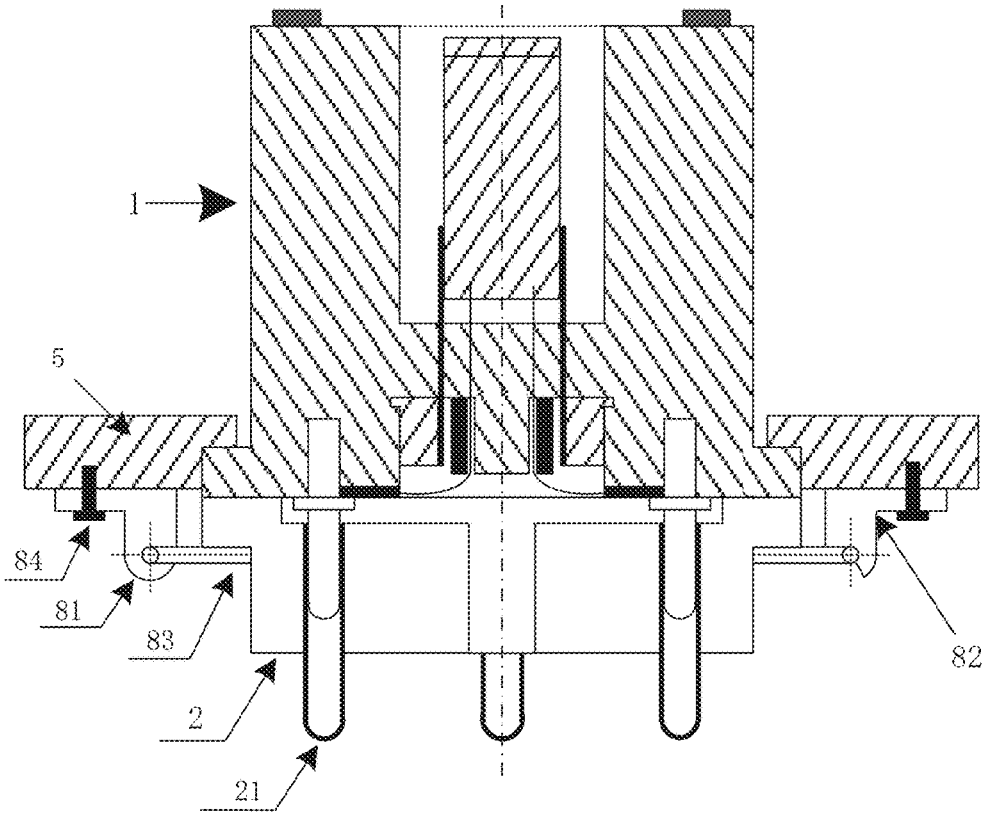
FIG. 7 is a schematic view of installing the cathode assembly of FIG. 6.
Figure 8:
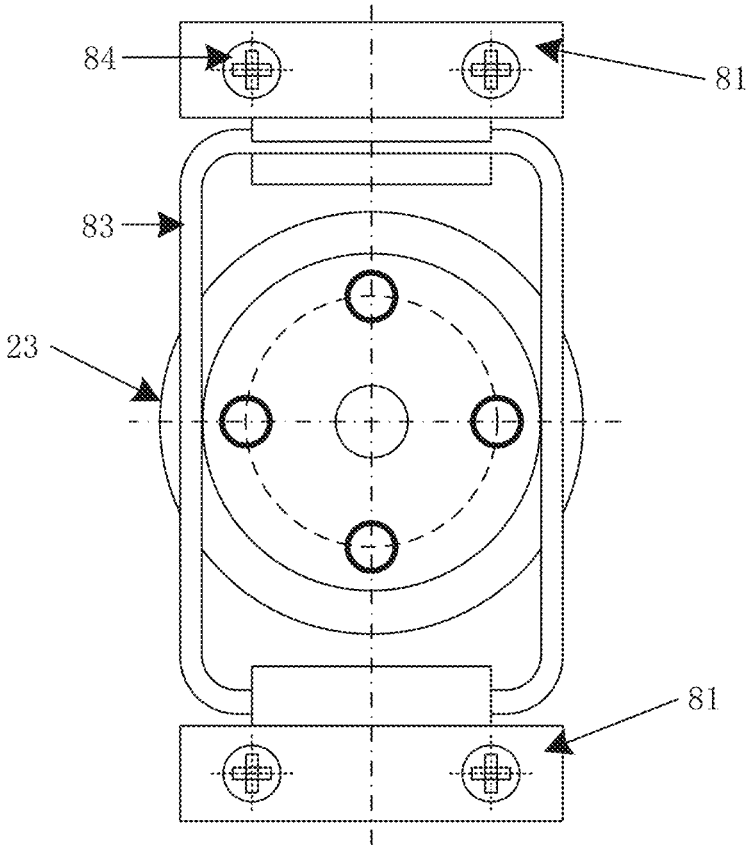
FIG. 8 is a rear-viewed diagram of the assembly after being installed and fixed.

FIG. 6 is a structural diagram of an X-ray source according to an embodiment of this disclosure. The X-ray source is an arranged light source, further including a vacuum chamber 3, an anode target 4, a mounting plate 5, a focus electrode 6 and a compensation electrode 7, besides of the cathode assembly 100 according to the embodiments of this disclosure.

The anode target 4, the cathode assembly 100, the mounting plate 5, the focus electrode 6 and the compensation electrode 7 are all disposed in the vacuum chamber 3. The anode target 4 and the mounting plate 5 are substantially parallel to each other. The mounting plate 5 and the anode target 4 are arranged at intervals. The focus electrode 6 is located between the mounting plate 5 and the anode target 4 while the compensation electrode 7 is located between the focus electrode 6 and the mounting plate 5. The distance between the anode 4, the focus electrode 6, the compensation electrode 7, and the mounting plate 5 may be adjusted according to the requirements. A ceramic pressure plate may be provided between the compensation electrode 7 and focus electrode 6 to achieve positioning the compensation electrode 7 and focus electrode 6. The anode target 4 is connected to the high-voltage power supply 93 outside the vacuum chamber 3 through a high-voltage connection device 91, whereas the focus electrode 6 and the compensation electrode 7 are connected to the compensation focus power supply 94 outside the vacuum chamber 3 via the high-voltage connection device 92.

A plurality of mounting holes 51 are provided on the mounting plate 5. A plurality of focus through holes 61, through which electrons pass, are provided on the focus electrode 6. The center lines of the focus through holes 61 and the mounting holes 51 are collinear respectively. A plurality of compensation through holes 71, through which the electrons pass, are provided on the compensation electrode 7. The center lines of the compensation through holes 71 and the focus through holes 61 are collinear respectively, such that the electrons orderly pass through the compensation through holes 71 and the focus through holes 61.

The cathode assembly 100 is detachably connected to the mounting hole 51. When the cathode assembly 100 is connected, the positioning part 10 on the ceramic plug 1 of the cathode assembly 100 is matched with the mounting hole 51 for a purpose of positioning the cathode assembly 100. It should be understood by the person skilled in the art that the ways for connecting the cathode assembly 100 to the mounting hole 51 is not limited. In this embodiment, the mounting plate 5 is provided with a locking device for locking the cathode assembly 100. The locking device includes a first cartridge 81, a second cartridge 82, and a pressure plate 83.

The first cartridge 81 and the second cartridge 82 are fixedly mounted on the mounting plate 5 by the fixing screws 84 and are respectively located on both sides of the mounting hole 51. The pressure plate 83 has one end pivotally connected to the first cartridge 81, and the pressure plate 83 may be in a locked state and an unlocked state. When the pressure plate 83 is in the locked state, the other end of the pressure plate 83 may be engaged with the second cartridge 82, at the moment, the pressure plate 83 may press against the ceramic socket 2 of the cathode assembly 100 such that the cathode assembly 100 is fixedly connected onto the mounting plate 5. When the pressure plate 83 is in the unlocked state, the pressure plate 83 is separated from the second cartridge 82 and away from the ceramic socket 2, as a result, the cathode assembly 100 may be removed from the mounting plate 5.

Furthermore, in this embodiment, the pressure plate 83 is a frame-type structure, and the ceramic socket 2 has an annular flange 23, and the pressure plate 83 may be sleeved on the ceramic socket 2 and press against the annular flange 23.

When the X-ray source according to the embodiment of this discourse is in use, the cathode 18 is at a ground potential, while the grid 12, the focus electrode 6 and the compensation electrode 7 are at a low positive pressure. An appropriate voltage is applied on the compensation electrode 7 for adjusting the electric field strength on both ends of the grid 12, to ensure that the electron has the smallest increase of the emittance after passing through the grid 12, thereby focusing of the beam current becomes easier. The voltage of the compensation electrode 7 is properly raised to reduce rate of the electrons captured by the grid 12 so as to improve the electron utilization rate. Voltage of the focus electrode may be adjusted to focus the beam current to a right dimension. The electrons emitted by the cathode 18 orderly pass through the grid 12, the compensation through hole 71 on the compensation electrode 7, and the focus through hole 61 on the focus electrode 6, and finally reach the anode target 4. The anode target 4 is at a positive high pressure, and the electron energy is thereby converted to X-ray at the anode target 4.

If it is required to replace the cathode assembly 100, what only need to do is to unlock the pressure plate 83 of the locking device, at the moment, the cathode assembly 100 is removed from the mounting plate 5, and then is replaced with a new cathode assembly. During this replacement action is not required for the focus electrode and the compensation electrode, and thereby the replacement is quick and easy, which reduces labor cost as desired for installation and replacement and also facilitates maintenance and replacement of the device.

This disclosure also discloses a CT device, which includes an X-ray source according to an embodiment of present disclosure.

The cathode assembly of this disclosure may be assembled by plugging the ceramic plug into the ceramic socket, and may be removed directly from the X-ray source when the cathode assembly is required to be replaced, without performing any operation to the focus electrode and the compensation electrode of the X-ray source, as a result, the installation and replacement are convenient and quick, labor cost as required for installation and replacement may be reduced, and maintenance and replacement of the device become easier.

While the present disclosure has been described in detail in connection with the exemplary embodiments, it should be readily understood that the present disclosure is not limited to such disclosed embodiments. Rather, various alternations and equivalents of such metes and bounds are therefore intended to be embraced by the appended claims.

What is claimed is:

1. A cathode assembly, comprising:

a ceramic plug having a first end portion and a second end portion arranged opposite to each other, wherein four wiring terminals are provided on an outer end surface of the first end portion, and a protruding positioning part is provided on a periphery surface of the first end portion; an internal cavity is formed in the ceramic plug, the internal cavity has an opening positioned at the second end portion; a cathode is provided in the internal cavity; the cathode has a filament with an positive electrode lead and a negative electrode lead; a grid is provided on an end surface of the second end portion and has a grid voltage signal line; the cathode has a cathode surface lead; and the positive electrode lead, the negative electrode lead, the grid voltage signal line and the cathode surface lead are electrically connected to one of the wiring terminals, respectively;

a ceramic socket having four wiring tubes, wherein the ceramic socket can be in contact with the first end portion of the ceramic plug, and the four wiring tubes can be electrically connected with the four wiring terminals.

2. The cathode assembly according to claim 1, wherein a groove for accommodating the grid voltage signal line is provided on the outer surface of the ceramic plug.

3. The cathode assembly according to claim 1, wherein the positioning part is an annular step.

4. The cathode assembly according to claim 1, wherein a counter bore is provided on the end surface of the first end portion of the ceramic plug; a metal fixing ring is fixedly arranged in the counter bore; and the metal fixing ring is connected with one of the wiring terminals to form the cathode surface lead; the cathode comprises a plurality of support legs that are fixedly connected to the metal fixing ring.

5. The cathode assembly according to claim 4, wherein the metal fixing ring is an elastic ring with an opening and has a snapping part bent outwardly; an annular slot is provided on the inner wall of the counter bore; and the snapping part is engaged in the annular slot; and the metal fixing ring is welded into the counter bore.

6. The cathode assembly according to claim 4, wherein a ceramic insulating ring positioned between the filament and the support leg is provided within the counter bore.

7. The cathode assembly according to claim 1, wherein the cathode is welded into the internal cavity.

8. The cathode assembly according to claim 1, wherein an air hole for draining air out of the ceramic plug is provided on the ceramic socket.

9. The cathode assembly according to claim 1, wherein the ceramic plug is a cylinder and also has a positioning hole on the outer end surface of the first end portion thereof, and the four wiring terminals and the positioning hole are arranged evenly around an axis of the ceramic plug.

10. An X-ray source, comprises:

a vacuum chamber;

an anode target provided in the vacuum chamber;

a mounting plate provided in the vacuum chamber and separately provided with the anode target, and a plurality of mounting holes are provided in the mounting plate;

a focus electrode, provided between the anode target and the mounting plate, wherein a plurality of focus through holes through which the electrons pass are provided on the focus electrode, center lines of the focus through holes and the mounting holes are collinear respectively;

a compensation electrode provided between the focus electrode and the mounting plate, wherein a plurality of compensation through holes through which the electrons pass are provided on the compensation electrode, and center lines of the compensation through holes and the focus through holes are collinear respectively such that the electrons can pass through the compensation through holes and the focus through holes orderly; and a plurality of cathode assemblies according to claim 1 are detachably connected to the mounting holes, wherein the positioning part of the ceramic plug of the cathode assembly is matched with the mounting hole to position the cathode assembly.

11. The X-ray source according to claim 10, wherein a ceramic pressure plate is provided between the focus electrode and the compensation electrode.

12. The X-ray source according to claim 10, wherein a locking device for locking the cathode assembly is provided on the mounting plate.

13. The X-ray source according to claim 12, wherein the locking device comprises:

a first cartridge fixedly provided on the mounting plate; and a second cartridge fixedly provided on the mounting plate, wherein the second cartridge and the first cartridge are positioned on both sides of the mounting hole, respectively;

a pressure plate having one end pivotally connected to the first cartridge, wherein the pressure plate may be in a locked state and an unlocked state; when the pressure plate is in the locked state, the other end of the pressure plate may be engaged with the second cartridge, and the pressure plate may press against the ceramic socket of the cathode assembly; when the pressure plate is in the unlocked state, the pressure plate is separated from the second cartridge and away from the ceramic socket.

14. The X-ray source according to claim 13, wherein the pressure plate has a frame-type structure, the ceramic socket has an annular flange, and the pressure plate may be sleeved in the ceramic socket and press against the annular flange.

15. The X-ray source according to claim 10, wherein the ceramic socket may be in contact with the first end portion of the ceramic plug, and the four wiring tubes may be electrically connected with the four wiring terminals.

16. The X-ray source according to claim 10, wherein a counter bore is provided on the end surface of the first end portion of the ceramic plug; a metal fixing ring is fixedly arranged in the counter bore; and the metal fixing ring is connected with one of the wiring terminals to form the cathode surface lead; the cathode comprises a plurality of support legs that are fixedly connected to the metal fixing ring.

17. The X-ray source according to claim 10, wherein the metal fixing ring is an elastic ring with an opening and has a snapping part bent outwardly; an annular slot is provided on the inner wall of the counter bore; and the snapping part is engaged in the annular slot; and the metal fixing ring is welded into the counter bore.

18. The X-ray source according to claim 10, wherein an air hole for draining air out of the ceramic plug is provided on the ceramic socket.

19. The X-ray source according to claim 10, wherein the ceramic plug has a cylindrical shape and also has a positioning hole on the outer end surface of the first end portion thereof, and the four wiring terminals and the positioning hole are arranged evenly around an axis of the ceramic plug.

20. A CT device, comprising the X-ray source according to claim 10.

* * * * *